US006308347B1

(12) United States Patent
King

(10) Patent No.: US 6,308,347 B1
(45) Date of Patent: Oct. 30, 2001

(54) TOILET SEAT LIFTING SYSTEM

(76) Inventor: John E. King, 803 Greenleaf Dr., Apt F, Fayetteville, NC (US) 28314

( * ) Notice: Subject to any disclaimer, the term of this patent is extended or adjusted under 35 U.S.C. 154(b) by 0 days.

(21) Appl. No.: 09/706,209

(22) Filed: Nov. 6, 2000

(51) Int. Cl.[7] ..... A47K 13/10
(52) U.S. Cl. ..... 4/246.1; 4/246.3
(58) Field of Search ..... 4/246.1–246.5, 4/248; 220/262, 263

(56) References Cited

U.S. PATENT DOCUMENTS

| | | | | |
|---|---|---|---|---|
| 428,001 | * | 5/1890 | Kaley | 4/246.1 |
| 816,886 | * | 4/1906 | Shonnard | 220/263 |
| 1,999,971 | * | 4/1935 | Williamson | 4/246.3 |
| 2,117,663 | * | 5/1938 | Hill . | |
| 2,723,400 | * | 11/1955 | Wilson | 4/246.1 |
| 4,470,161 | * | 9/1984 | Seabrooke | 4/246.3 |
| 5,237,708 | * | 8/1993 | Zamoyski | 4/246.3 |
| 5,311,619 | * | 5/1994 | Ward | 4/246.1 |
| 5,829,068 | * | 11/1998 | Smith | 4/246.3 |
| 6,112,335 | * | 9/2000 | Gaston | 4/246.1 |

FOREIGN PATENT DOCUMENTS

| | | | | |
|---|---|---|---|---|
| 72094 | * | 1/1893 | (DE) | 4/246.3 |

* cited by examiner

*Primary Examiner*—Charles R. Eloshway

(57) ABSTRACT

The toilet seat lifting system includes a lifting bracket secured to a seat of a toilet, a vertical member, a stabilizer bar locks between the toilet seat bolts and engage the upper portion of the vertical member, a spring attached to the stabilizer bar and the rear of the toilet seat, a lever arm pivotally attached to a lower portion of the vertical member, a pair of support arms attached to an upper portion of the vertical member extending at an angle from thereof, an air cylinder attached between the vertical member and the lever arm, two pulleys rotatably attached to an upper portion of the vertical member, and a length of cord attached to the lever arm extending about the pulleys and attached to the lifting bracket for allowing elevating and lowering of the seat, outer covers attached to vertical member and the support arms concealing inner components and providing a decorative exterior.

13 Claims, 4 Drawing Sheets

TOILET SEAT LIFTING SYSTEM

BACKGROUND OF THE INVENTION

1. Field of the Invention

The present invention relates generally to toilet seats and more specifically it relates to a toilet seat lifting system for conveniently elevating and lowering a toilet seat in a sanitary manner.

2. Description of the Prior Art

Toilet seats have been in use for years. Typically, a toilet seat is oval shaped structure having a center opening which is pivotally attached upon a conventional toilet. Men often times raise the toilet seat in order to urinate within the conventional toilet to avoid contaminating the toilet seat.

The main problem with conventional toilet seats is that when the toilet seat is lifted the user must take the time and energy to lower the toilet seat upon the conventional toilet for the next user. In addition, it can be extremely unsanitary for an individual to lift a toilet seat with their hands.

Examples of patented toilet related devices include U.S. Pat. No. 5,323,496 to Blair; U.S. Pat. No. 5,487,192 to Hodges; U.S. Pat. No. 5,875,498 to Joseph; U.S. Pat. No. 5,857,223 to Ferdinand; U.S. Pat. No. 5,829,068 to Smith; U.S. Pat. No. 5,852,833 to Gregoire; U.S. Pat. No. 5,742,949 to Goldi et al.; U.S. Pat. No. 5,594,958 to Nguyen; U.S. Pat. No. 5,448,782 to Ratajac; U.S. Pat. No. 4,803,741 to Ellison; U.S. Pat. No. 5,327,589 to Rice; U.S. Pat. No. 4,030,146 to Pilkington et al. which are all illustrative of such prior art.

While these devices may be suitable for the particular purpose to which they address, they are not as suitable for conveniently elevating and lowering a toilet seat in a sanitary manner. Conventional toilet seats require the user to remember to take the time and energy to lower after raising.

In these respects, the toilet lifting system according to the present invention substantially departs from the conventional concepts and designs of the prior art, and in so doing provides an apparatus primarily developed for the purpose of conveniently elevating and lowering a toilet seat in a sanitary manner.

SUMMARY OF THE INVENTION

In view of the foregoing disadvantages inherent in the known types of toilet seat Devices now present in the prior art, the present invention provides a new toilet seat lifting system construction wherein the same can be utilized for conveniently elevating and lowering a toilet seat in a sanitary manner.

The general purpose of the present invention, which will be described subsequently in greater detail, is to provide a new toilet seat lifting system that has many of the advantages of the toilet seat devices mentioned heretofore and many navel features that result in a new toilet seat lifting system which is not anticipated, rendered obvious, suggested, or even implied by any of the prior art toilet seat devices, either alone or in any combination thereof.

To attain this, the present invention generally comprises a bracket secured to a toilet seat of a toilet, a vertical member, a lever arm pivotally attached to a lower portion of the vertical member, a pair of support arms attached to an upper portion of the vertical member extending at an angle from thereof, an air cylinder attached between the vertical member, and the lever arm, two pulleys rotatably attached to an upper portion of the vertical member, and a length of cord attached to the lever arm extending about the pulleys and attached to the bracket for allowing elevating and lowering of the seat. A second bracket inserts between the two toilet seat bolts and rotates forward locking in place to add additional support to the device. A spring located at the back of the seat assists in the seat's rotation downward. when raised to or pass 90 degrees.

There has thus been outlined, rather broadly, the more important features of the invention in order that the detailed description thereof may be better understood, and in order that the present contribution to the art may be better appreciated, There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a toilet seat lifting system that will overcome the shortcomings of the prior art devices.

A second object is to provide a toilet seat lifting system for conveniently elevating and lowering a toilet seat in a sanitary manner.

Another object is to provide a toilet seat lifting system that does not require an individual to utilize their hands to raise or lower a toilet seat.

An additional object is to provide a toilet seat lifting system that does not interfere with the normal operation of a conventional toilet.

A further object is to provide a toilet seat lifting system that can be attached to existing conventional toilets without significant modifications.

Another object is to provide a toilet seat lifting system that is lightweight, easily installed, easy to operate, reduces time, reduces individual effort, and durable.

A further object is to provide a toilet seat lifting system that eliminates the need for an individual to bend over to elevate the toilet seat.

Other objects and advantages of the present invention will become obvious to the reader and it is intended that these objects and advantages are within the scope of the present invention.

To the accomplishmnent of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 2:
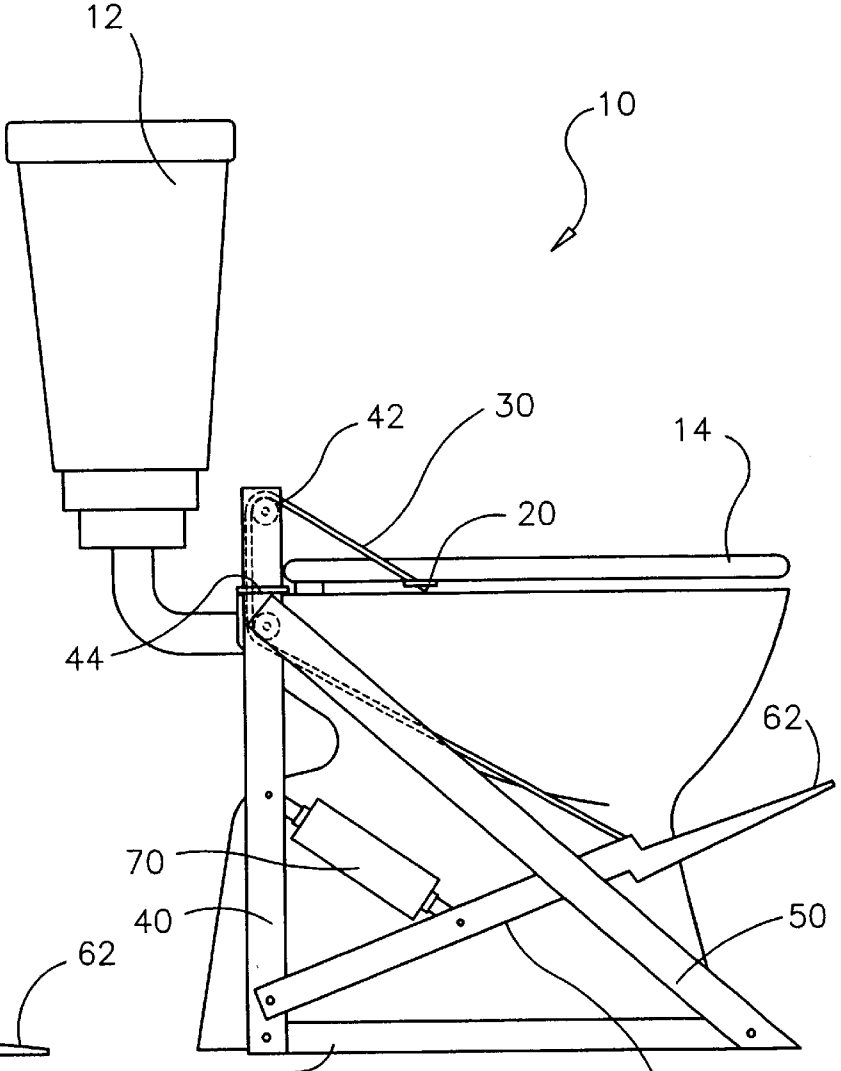
FIG. 2 is a side view of the present invention with the seat lowered.

Turning now descriptively to the drawings, in which similar reference characters denote similar elements throughout the several views, FIGS. 1 through 5 illustrate a toilet seat lifting system 10, which comprises a bracket 20 secured to a seat 14 of a toilet 12, a vertical member 40, a lever arm 60 pivotally attached to a lower portion of the vertical member 40, a pair of support arms 50 attached to an upper portion of the vertical member 40 extending at an angle from thereof, an air cylinder 70 attached between the vertical member 40 and the lever arm 60, two pulleys 42 rotatably attached to an upper portion of the vertical member 40, and a length of cord 30 attached to the lever arm 60 extending about the pulleys 42 and attached to the bracket 20 for allowing elevating and lowering of the seat 14.

As shown in FIGS. 1 through 5 of drawings, a vertical member 40 is provided having an upper portion and a lower portion. The vertical member 40 may be constructed of various types of materials, structures and shapes as can be appreciated. The vertical member 40 may be tubular or solid in structure. The vertical member 40 must be constructed into a rigid structure to support the forces applied during the elevating and lowering of the seat 14. If the vertical member 40 is tubular, the upper end of the vertical member 40 would include a cap member to prevent debris from entering the interior portion of the vertical member 40.

As further shown in FIGS. 1 through 5 of the drawings, at least one support arm is attached to the upper portion of the vertical member 40 and extending downwardly at an angle to engage a floor surface within the bathroom thereby providing increased stability to the vertical member 40 during operation. The support arm preferably extends forwardly with respect to the toilet 12 to compensate for the weight of the seat 14 during operation.

Figure 1:
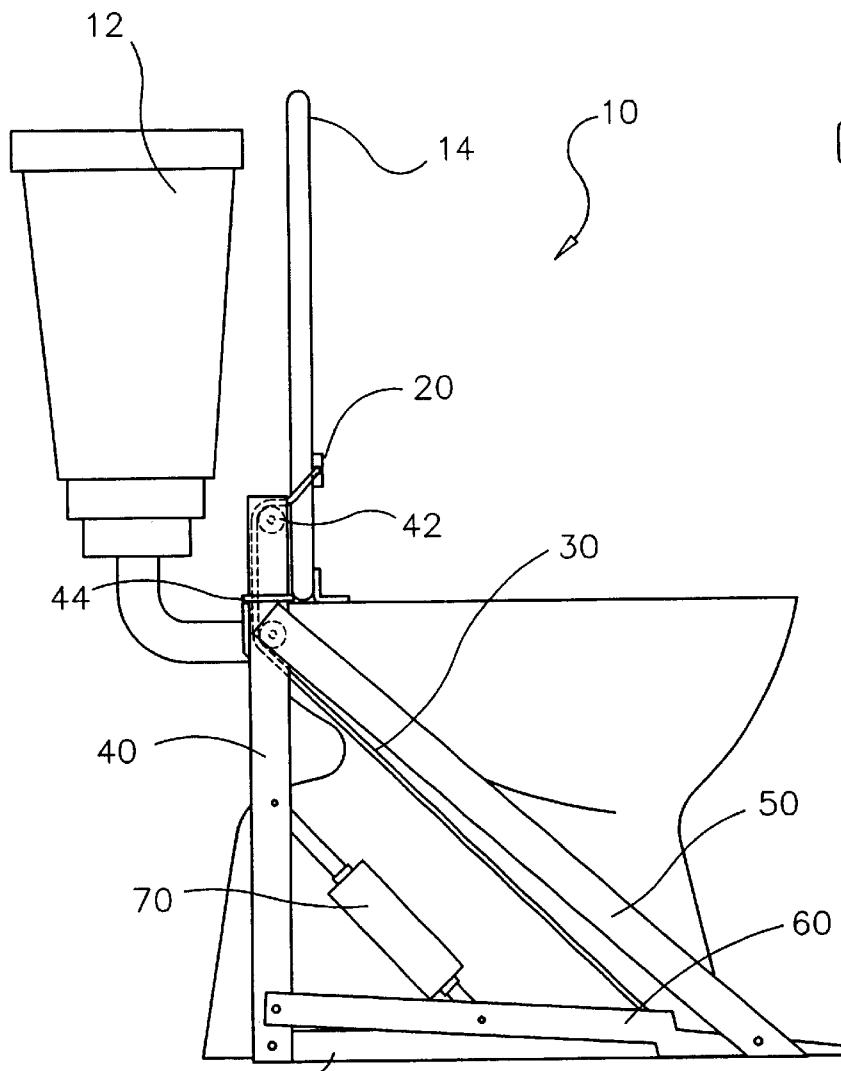
FIG. 1 is a side view of the present invention with the seat raised.

As best shown in FIGS. 1 and 2 of the drawings, a lever arm 60 is pivotally attached to the vertical member 40. The lever arm 60 may be attached to any portion of the vertical member 40, however the lever arm 60 is preferably attached to the lower portion of the vertical member 40. The lever arm 60 includes an engaging end 62 opposite of the vertical member 40 for allowing engagement by the user with their foot. The engaging end 62 may be tapered as shown in FIGS. 1 and 2 of the drawings. The engaging end 62 may also include a gripping material to aide the foot of the user in engaging the engaging end 62 of the lever arm 60.

As shown in FIGS. 1 through 5 of the drawings, two pulleys 42 are rotatably attached to the upper portion of the vertical member 40 for receiving and supporting a portion of the length of cord 30. The pulleys 42 may be attached within the vertical member 40 if the vertical member 40 is tubular in structure or the pulleys 42 may be attached externally of the vertical member 40. The pulleys 42 reduces the resistance incurred during the elevating and lowering of the seat 14 of the toilet 12.

As shown in FIGS. 1 through 5 of the drawings, the length of cord 30 is attached to the lever arm 60 extending about the pulleys 42 and is attached to the seat 14 of the toilet 12 opposite of the lever arm 60 for allowing elevating and lowering of the seat 14. The length of cord 30 may be directly connected to seat 14. The cord 30 may be comprised of any well-known material such as nylon.

Figure 3:
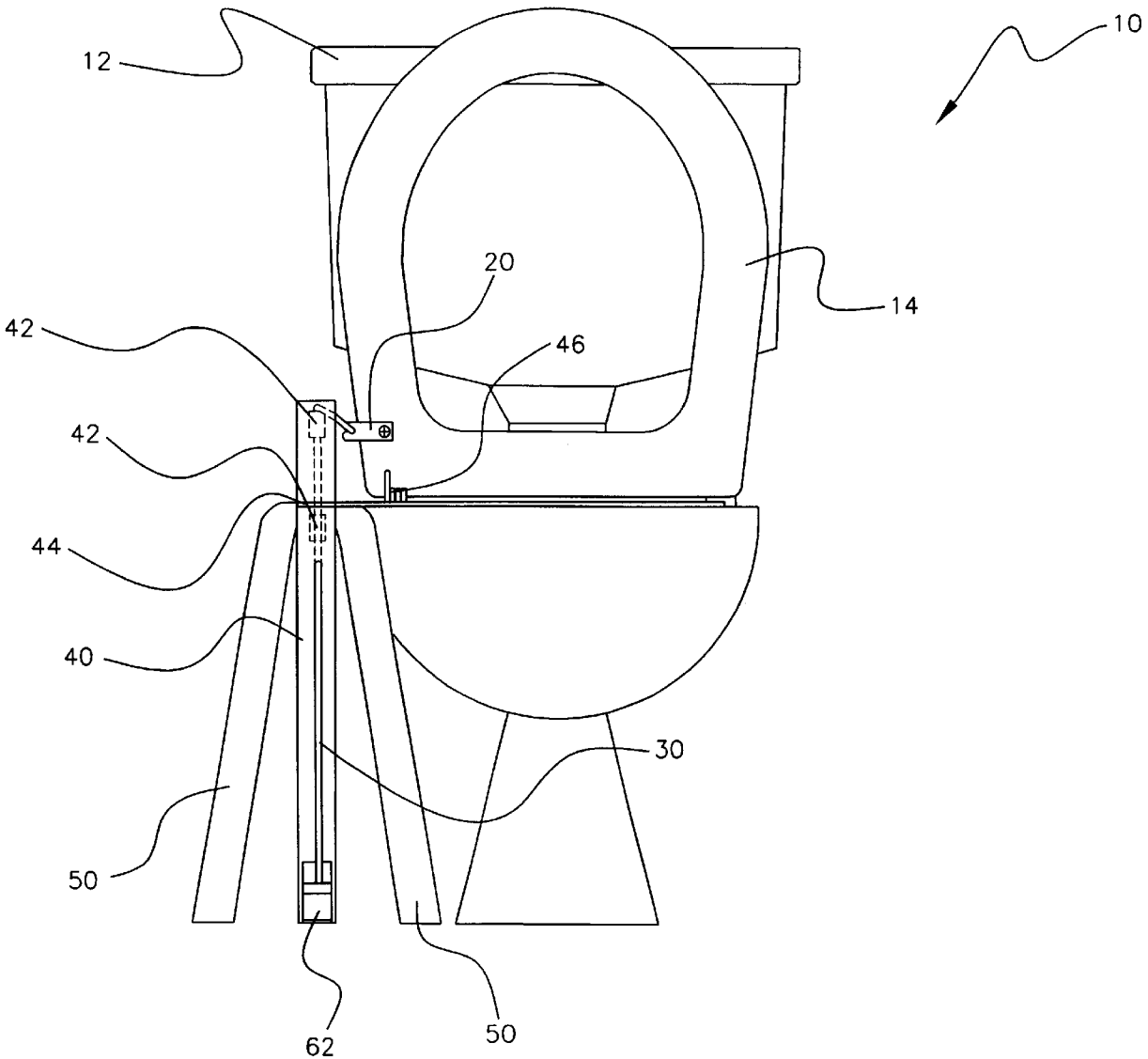
FIG. 3 is a front view of the present invention with the seat raised.

As best shown in FIG. 3 of drawings, a lifting bracket 20 is attached to the seat 14 and is connected to the length of cord 30 opposite of the lever ann 60. As further shown in FIG. 3 of the drawings, the lifting bracket 20 preferably extends from a side of the seat 14 a finite distance to allowing receiving of the cord 30.

As best shown in FIGS. 1 and 2 of the drawings, a means for dampening the lowering of the seat 14 is provided to prevent the accidental falling of the seat 14 upon the toilet 12 when the foot is released from the lever arm 60. The means for dampening is preferably comprised of an air cylinder 70 or the like that allows low resistance during the elevating of the seat 14 however providing increased resistance during the lowering of the seat 14.

As shown in FIGS. 1 and 2 of the drawings, a cross member 52 extends between the lower portion of the vertical member 40 and to a distal end of the at least one support arm. The cross member 52 provides additional support to the vertical member 40 and the at least one support arm during operation of the present invention.

As shown in FIGS. 1 through 5 and 9 of the drawings, a stabilizer bar 44 is preferably provided that extends from the upper portion of the vertical member 40 to the toilet 12 for providing increased stability to the vertical member 40 during operation. The stabilizer bar 44 may be comprised of any rigid structure. The stabilizer bar 44 is inserted between the two toilet seat mounting bolts and rotated forward locking into place parallel to the toilet 12, extending out to the side of the toilet 12 to engage the upper portion of the vertical member 40. It may also be directly attached to a hinge of the seat 14 of the toilet 12.

Figure 5:
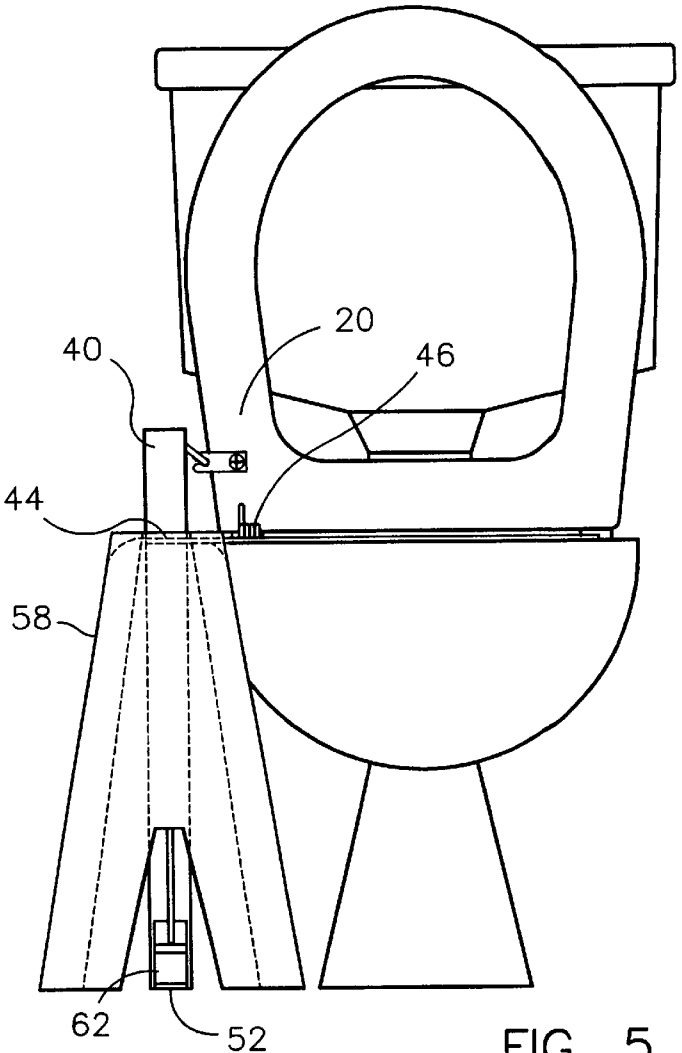
FIG. 5 is a front view of the present invention with the front cover.
Figure 4:
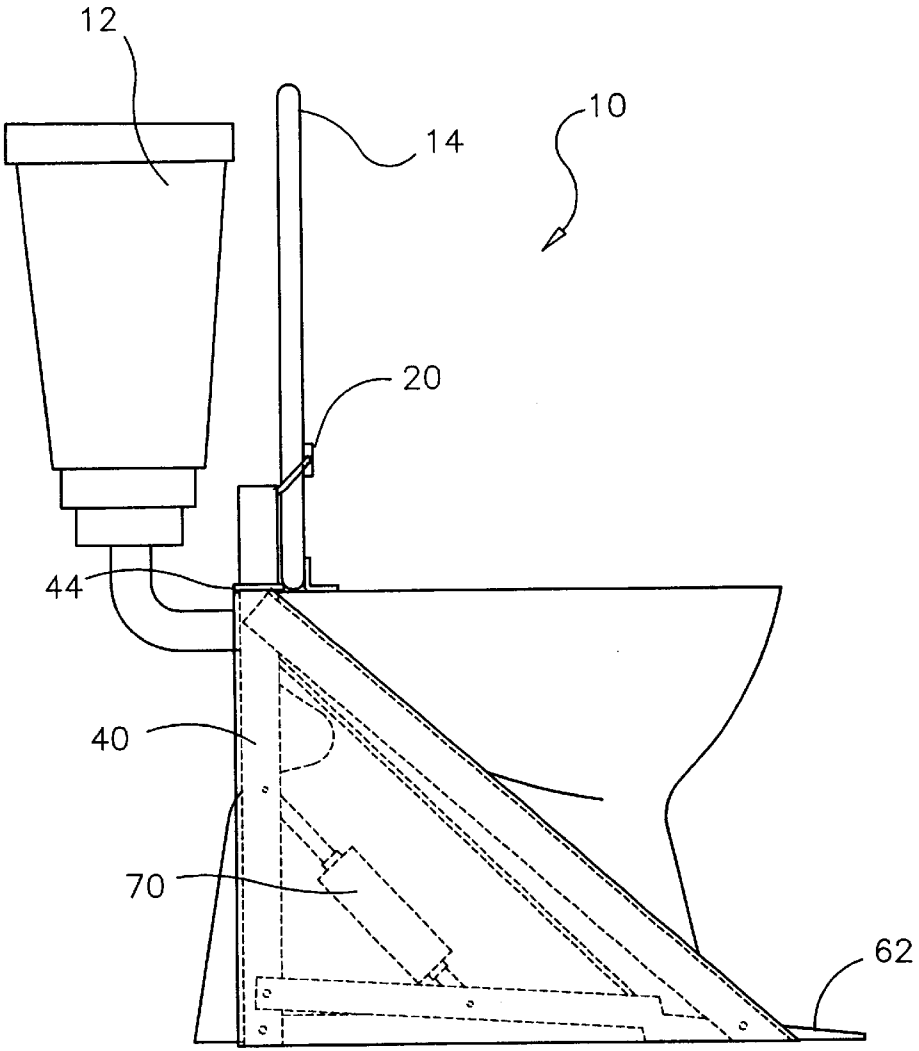
FIG. 4 is a side view of the present invention with the side cover.
Figure 6:
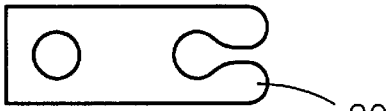
FIG. 6 is a view of the present invention's lifting bracket.
Figure 7:
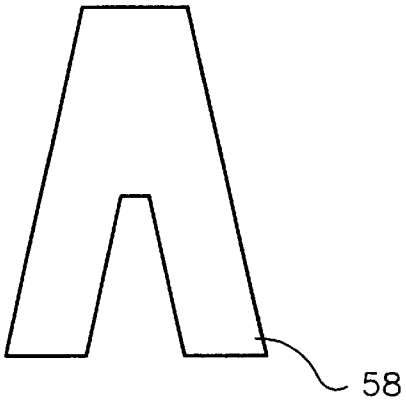
FIG. 7 is a front view of the present invention's front cover.
Figure 8:
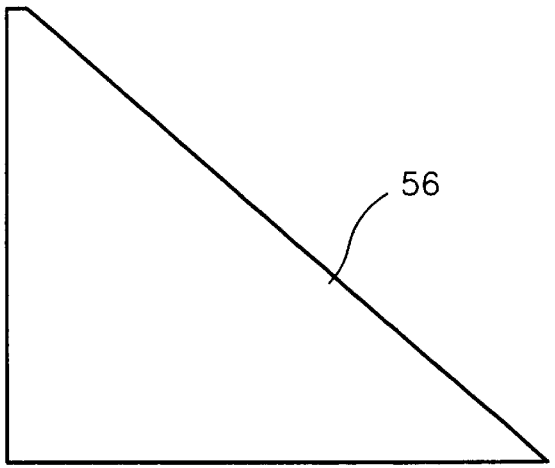
FIG. 8 is a view of the present invention's side cover.
Figure 9:
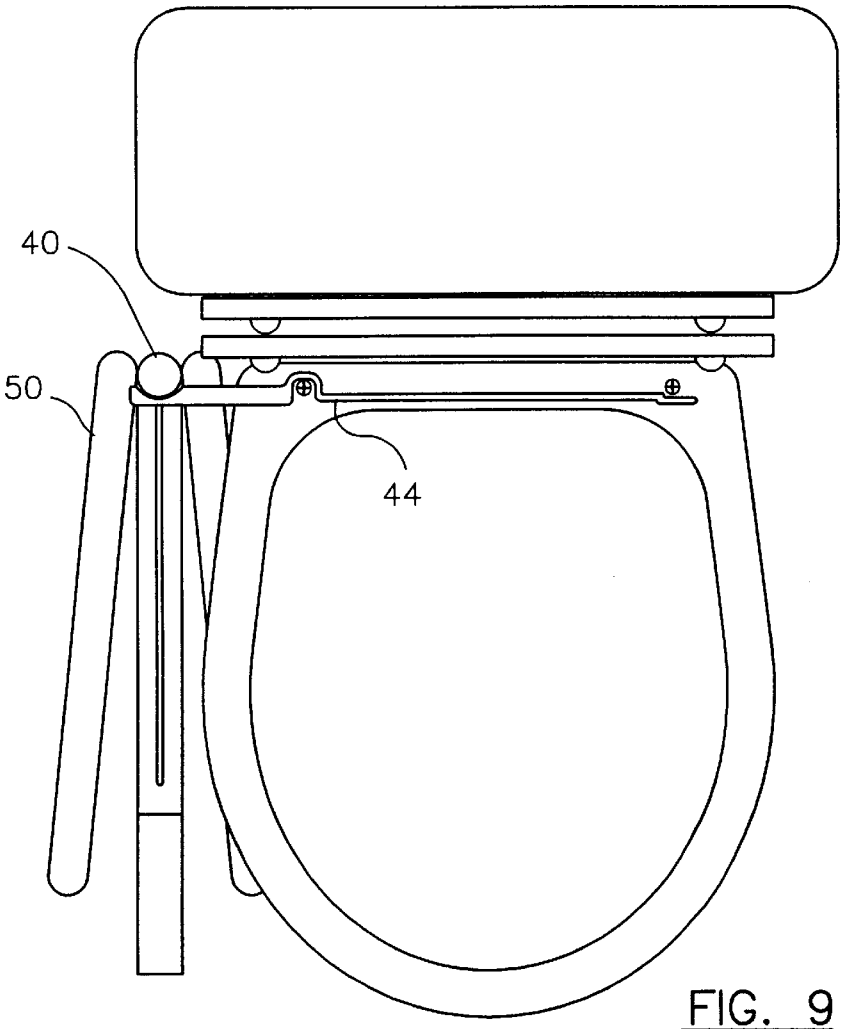
FIG. 9 is a top view of the present invention's stabilizer bar.

In use, the user approaches the toilet 12 and engages the engaging end 62 of the lever arm 60 with the lower portion of their foot. As the lever arm 60 is pivoted downwardly with respect to the vertical member 40, the cord 30 positioned about the pulleys 42 draws the seat 14 upwardly into a substantially vertical position as shown in FIG. 1 of the drawings. The seat 14 is rotated less than 90 degrees with respect to a lowered position during elevating of the seat 14 for allowing the seat 14 to remain at a slight angle which provides sufficient force from gravity to lower the seat 14 upon the toilet 12 when the user removes the foot from the lever arm 60. A spring 46 assists toilet seat 14 in rotating forward until gravity takes over, when toilet seat 14 is elevated to or pass 90 degrees, as shown in FIGS. 3 and 5.

After the user is finished utilizing the toilet 12, the user then releases their foot from the lever arm 60 which allows gravity to pull the seat 14 downwardly upon the toilet 12. The air cylinder 70 provides sufficient resistance to the lowering of the seat 14 for preventing a fast fall and engagement of the seat 14 upon the toilet 12. The seat 14 is slowly lowered upon the toilet 12 until back into a substantially horizontal position as shown in FIG. 2 of the drawings.

As best shown in FIGS. 4, 5, 7 and 8 of the drawings, the decorative covers 54, 56 and 58 are attached to the invention frame: left side cover 54 attached to vertical member 40 and support arm 50, right side cover 56 attached to vertical member 40 and support arm 50 and front cover 58 attached to both support arms 50. Covers are comprised of light weight plastic or wall paper. Covers conceal internal components and provide a decorative external appearance to the device.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet seat lifting system for elevating and lowering a seat of a toilet, comprising:

a vertical member having an upper portion and a lower portion;

at least one support arm attached to said upper portion of said vertical member and extending downwardly at an angle;

a lever arm pivotally attached to said vertical member;

two pulleys rotatably attached to said upper portion of said vertical member;

a lifting bracket attachable to said seat; and a length of cord attached to said lever arm and extending about said pulleys and attached to said lifting bracket for elevating and lowering said seat when said lever arm is manually manipulated by a user.

2. The toilet seat lifting system of claim 1, wherein said lifting bracket is attachable to said seat and extendable from a side of said seat a finite distance.

3. The toilet seat lifting system of claim 1, wherein said pulleys are positioned within said vertical member.

4. The toilet seat lifting system of claim 1, including a means for dampening said lowering of said seat.

5. The toilet seat lifting system of claim 4, wherein said means for dampening is comprised of an air cylinder.

6. The toilet seat lifting system of claim 1, wherein said lever arm has an engaging end opposite of said vertical member for allowing engagement by a foot of a user.

7. The toilet seat lifting system of claim 1, wherein said seat is rotated less than 90 degrees with respect to a lowered position during elevating of said seat for allowing said seat to remain at a slight angle which provides sufficient force from gravity to lower said seat upon said toilet when said user removes said foot from said lever arm.

8. The toilet seat lifting system of claim 1, including a spring attached to a rear portion of said toilet seat and said stabilizer bar assisting in the forward rotation of said toilet seat when said toilet seat is elevated to or past 90 degrees.

9. The toilet seat lifting system of claim 1, including a cross member extending between said lower portion of said vertical member and to a distal end of said at least one support arm.

10. The toilet seat lifting system of claim 9, including a stabilizer bar extendable from said upper portion of said vertical member to said toilet for providing increased stability to said vertical member during operation.

11. The toilet seat lifting system of claim 10, wherein said stabilizer bar is insertable between the two toilet seat mounting bolts and rotated forward locking in place at a position parallel to said toilet or attachable to a hinge of said seat of said toilet.

12. The toilet seat lifting system of claim 1, wherein said length of cord is comprised of a nylon material.

13. The toilet seat lifting system of claim 1, a plurality of covers attached to said vertical member and said at least one support arm to conceal internal components and provide a decorative exterior.

* * * * *